US009850752B2

(12) United States Patent
Thomas et al.

(10) Patent No.: US 9,850,752 B2
(45) Date of Patent: Dec. 26, 2017

(54) HYDRAULICALLY-METERED DOWNHOLE POSITION INDICATOR

(71) Applicant: Halliburton Energy Services, Inc., Houston, TX (US)

(72) Inventors: Phillip T. Thomas, The Colony, TX (US); Robert Ken Michael, Sachse, TX (US); Samuel Martinez, Cedar Hill, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 494 days.

(21) Appl. No.: 14/394,553

(22) PCT Filed: Oct. 29, 2013

(86) PCT No.: PCT/US2013/067238
§ 371 (c)(1),
(2) Date: Oct. 15, 2014

(87) PCT Pub. No.: WO2015/065332
PCT Pub. Date: May 7, 2015

(65) Prior Publication Data

US 2015/0152725 A1 Jun. 4, 2015

(51) Int. Cl.
*E21B 47/09* (2012.01)
*E21B 34/12* (2006.01)
*E21B 34/06* (2006.01)

(52) U.S. Cl.
CPC ..... *E21B 47/09* (2013.01); *E21B 34/06* (2013.01); *E21B 34/125* (2013.01)

(58) Field of Classification Search
CPC ..... E21B 23/02; E21B 23/06; E21B 17/07; E21B 47/09; E21B 33/1295
See application file for complete search history.

(56) References Cited

U.S. PATENT DOCUMENTS 5,211,241 A 5/1993 Mashaw, Jr. et al.
5,941,306 A 8/1999 Quinn
(Continued)

FOREIGN PATENT DOCUMENTS

EP 0431689 A1 6/1991
WO WO 2014098797 A1 * 6/2014 ..... E21B 23/02
WO 2015065332 A1 5/2015

OTHER PUBLICATIONS

International Search Report and Written Opinion for PCT/US2013/067238 dated Jul. 29, 2014.

*Primary Examiner* — Robert E Fuller
*Assistant Examiner* — David Carroll
(74) *Attorney, Agent, or Firm* — McDermott Will & Emery LLP

(57) ABSTRACT

A position-indicating tool includes an outer mandrel that accommodates two or more indicator lugs movable between a first position, where the indicator lugs extend past an outer diameter of the outer mandrel, and a second position, where indicator lugs are radially contracted within the outer diameter, an inner mandrel arranged at least partially within the outer mandrel and providing a radial protrusion that radially supports the indicator lugs in the first position, and a pressure block arranged between the outer and inner mandrels to control a flow of hydraulic fluid between an upper hydraulic chamber and a lower hydraulic chamber, wherein, when a pressure threshold is exceeded in the lower hydraulic chamber, the hydraulic fluid is able to flow into the upper hydraulic chamber and thereby allow the outer mandrel to axially translate with respect to the inner mandrel and move the indicator lugs to the second position.

22 Claims, 4 Drawing Sheets

(56) References Cited

U.S. PATENT DOCUMENTS

| | | | |
|---|---|---|---|
| 6,367,552 | B1 | 4/2002 | Scott et al. |
| 6,540,025 | B2 | 4/2003 | Scott et al. |
| 2006/0225878 | A1 | 10/2006 | Coronado |
| 2011/0056678 | A1 | 3/2011 | O'Brien |

* cited by examiner

HYDRAULICALLY-METERED DOWNHOLE POSITION INDICATOR

BACKGROUND

The present disclosure is related to downhole tools used in the oil and gas industry and, more particularly, to repeatable position indication for downhole tools.

In the oil and gas industry, knowing where a tool string or work string is located within a wellbore is an essential part of effective hydrocarbon exploration and production. Presently, downhole tool strings employ repeatable collets or snap rings (collectively "position indicators") that provide positive location indication of the associated downhole tools. In operation, the position indicators are forced into and/or through sized indicator profiles (collectively "indicator profiles") arranged at predetermined locations within the wellbore. Once the position indicators enter these indicator profiles, an axial "snap" force may be detected or otherwise seen at the surface as the associated spring-loaded components of the position indicators radially expand into the indicator profiles and an axial load change is measured at the surface (i.e., a rig floor).

While conventional position indicators are repeatable, the spring force or snap value of their associated spring-loaded components tends to degrade over time, thereby making it difficult to measure positive location indication at the surface. One solution to this is to manufacture more robust position indicators that exhibit a larger spring force intended to lengthen the useful life of the position indicator. However, if the spring force of a position indicator is too large, various downhole equipment may be damaged, such as seal bores and even the indicator profiles themselves.

Moreover, in some deeper wells, especially in lateral wells where a large portion of the work string lies on the bottom of the wellbore, it is oftentimes difficult to transmit axial loads uphole that can be reliably seen with surface rig equipment. In other applications, the position indicators are required to pass through indicator profiles that are arranged fairly close to each other within the wellbore. In such cases, it is often difficult to determine which indicator profile the position indicator passed through since the tool string can axially bounce upon entering an indicator profile. As a result, ascertaining the difference between axial loads associated with adjacent indicator profiles measured with surface rig equipment can be quite difficult.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to downhole tools used in the oil and gas industry and, more particularly, to repeatable position indication for downhole tools.

Disclosed is a position-indicating tool that can be used to positively locate one or more downhole tools within a wellbore. The position-indicating tool includes two or more indicator lugs that are able to extend radially past the outer diameter of the tool in order to engage indicator profiles provided at predetermined locations within the wellbore. Upon encountering an indicator profile, the tool ceases movement until a fluid metering valve is breached and thereby allows flow of hydraulic fluid between upper and lower hydraulic chambers. Breaching the fluid metering valve can be achieved by applying a prescribed or predetermined axial load on the position-indicating tool. Once hydraulic fluid is able to pass through the fluid metering device, a steady rate of fluid flow is achieved, which translates into a steady and predictable rate of actuation for the position-indicating tool. As the hydraulic pressure slowly bleeds from the lower hydraulic chamber into the upper hydraulic chamber, the indicator lugs are gradually moved out of engagement with the indicator profile, thereby allowing the position-indicating tool to bypass the indicator profile. Once past the indicator profile, a power spring is used to return the indicator lugs back to their original position. As will be appreciated, the position-indicating tool provides a consistent, repeatable position indication for downhole tools.

Figure 1:
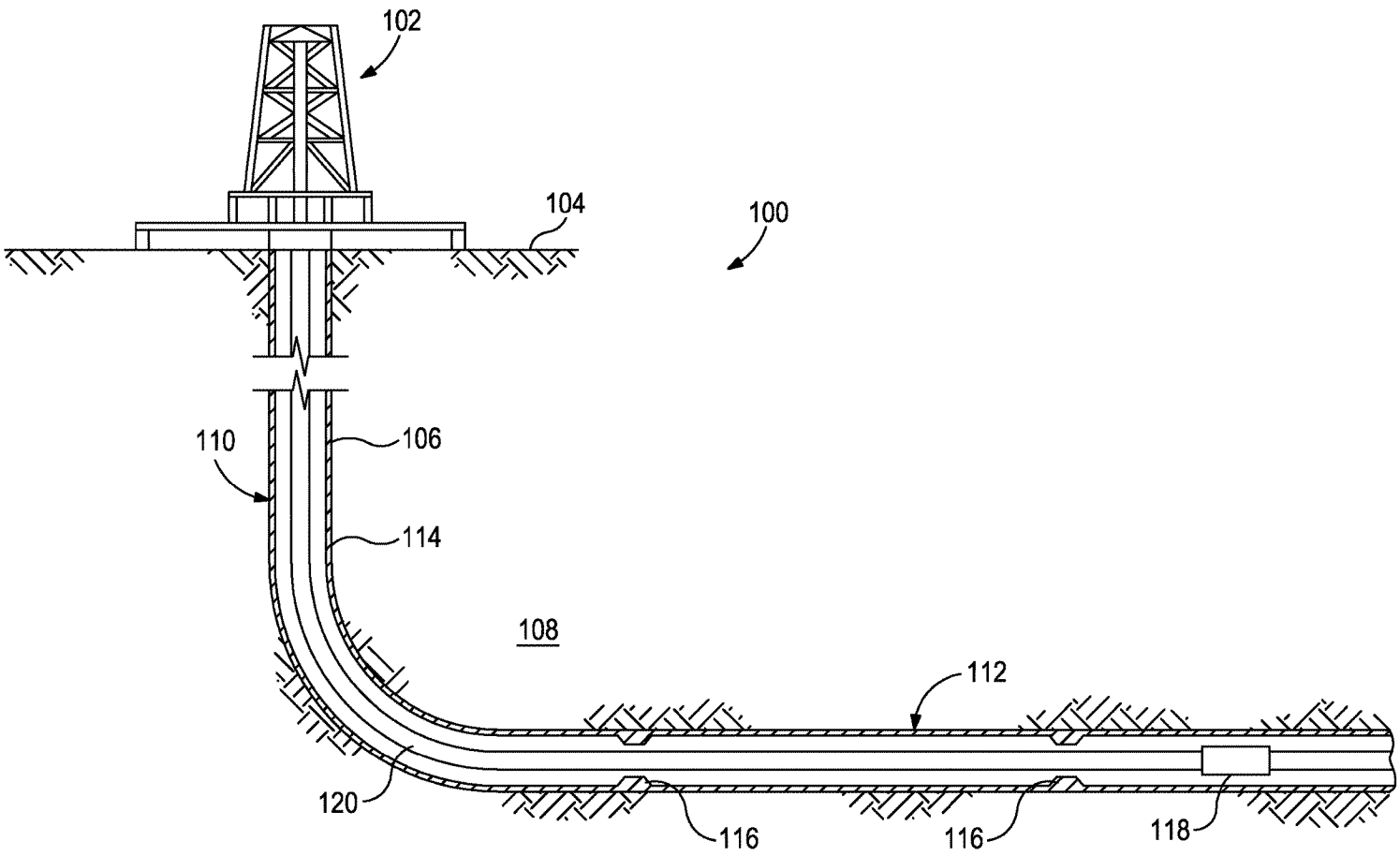
FIG. 1 illustrates an exemplary well system that may embody or otherwise employ one or more principles of the present disclosure, according to one or more embodiments.

Referring to FIG. 1, illustrated is a well system 100 that may embody or otherwise employ one or more principles of the present disclosure, according to one or more embodiments. As illustrated, the well system 100 may include a service rig 102 that is positioned on the earth's surface 104 and extends over and around a wellbore 106 that penetrates a subterranean formation 108. The service rig 102 may be a drilling rig, a completion rig, a workover rig, or the like. In some embodiments, the service rig 102 may be omitted and replaced with a standard surface wellhead completion or installation. Moreover, while the well system 100 is depicted as a land-based operation, it will be appreciated that the principles of the present disclosure could equally be applied in any sea-based or sub-sea application where the service rig 102 may be a floating platform or sub-surface wellhead installation, as generally known in the art.

The wellbore 106 may be drilled into the subterranean formation 108 using any suitable drilling technique and may extend in a substantially vertical direction away from the earth's surface 104 over a vertical wellbore portion 110. At some point in the wellbore 106, the vertical wellbore portion 110 may deviate from vertical relative to the earth's surface 104 and transition into a substantially horizontal wellbore portion 112. In some embodiments, the wellbore 106 may be at least partially lined with a wellbore tubing 114. The wellbore tubing 114 may refer to any downhole tubing or string of tubulars known to those skilled in the art including, but not limited to, casing, wellbore liner, production tubing, drill string, gravel pack strings or inserts, or other downhole piping systems.

As illustrated, the wellbore tubing 114 may include one or more indicator profiles 116 (two shown) defined on the inner radial surface of the wellbore tubing 114. In some embodiments, the indicator profiles 116 may be radial protrusions or shoulders that extend radially inward from the inner walls of the wellbore tubing 114. Each indicator profile 116 may each be arranged at a predetermined location within the wellbore 106 such that an accurate determination of the location of various downhole tools (not shown) may be established by a well operator upon interacting with the particular indicator profile 116.

The system 100 may further include a position-indicating tool 118 conveyed into the wellbore 106. The position-indicating tool 118 may be coupled or otherwise attached to a work string 120 that extends from the service rig 102. The work string 120 may be, but is not limited to, production tubing, drill string, wellbore tubing, or any other wellbore tubular known to those skilled in the art. As discussed below, the position-indicating tool 118 may be configured to locate and interact with the indicator profiles 116, and thereby provide a well operator with positive position indicators for one or more downhole tools (not shown) also associated with the work string 120.

Even though FIG. 1 depicts the position-indicating tool 118 as being arranged and operating in the horizontal portion 112 of the wellbore 106, the embodiments described herein are equally applicable for use in portions of the wellbore 106 that are vertical, deviated, or otherwise slanted. Moreover, use of directional terms such as above, below, upper, lower, upward, downward, uphole, downhole, and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well. As used herein, the term "proximal" refers to that portion of the component being referred to that is closest to the wellhead, and the term "distal" refers to the portion of the component that is furthest from the wellhead.

Figure 2A:
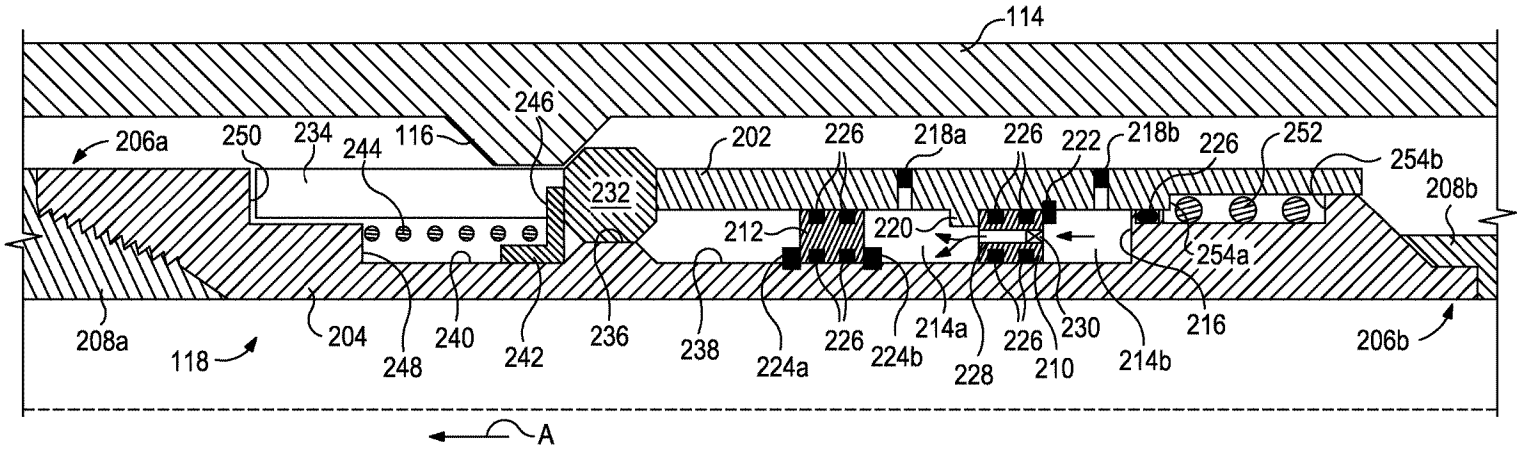
FIGS. 2A and 2B illustrate cross-sectional side views of the exemplary position-indicating tool of FIG. 1, according to one or more embodiments.
Figure 2B:
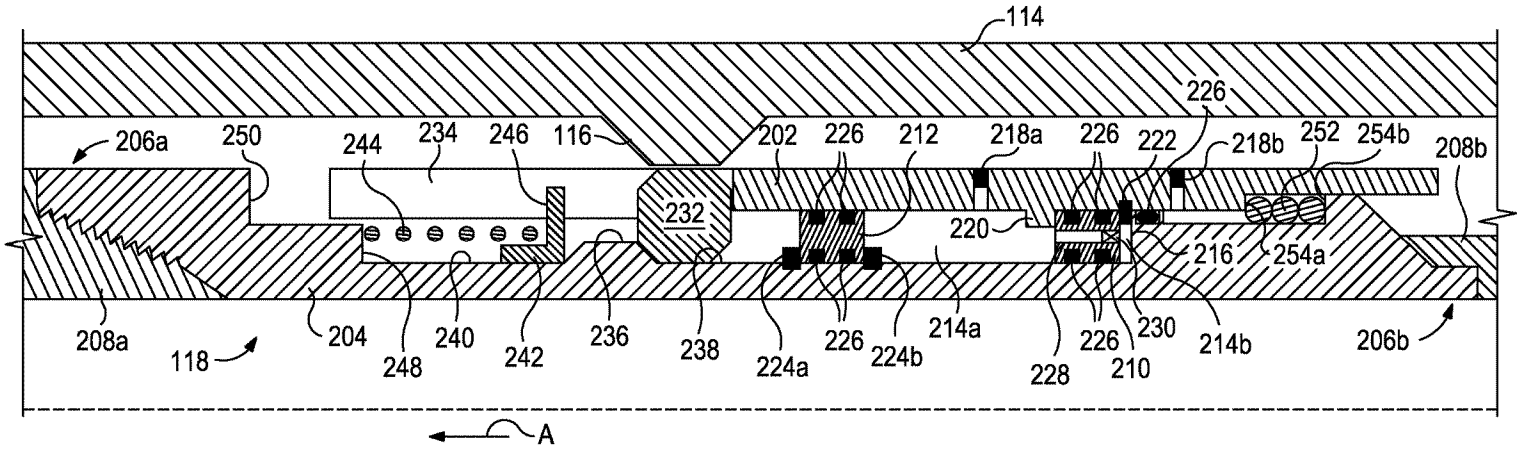

Referring now to FIGS. 2A and 2B, with continued reference to FIG. 1, illustrated are cross-sectional side views of the exemplary position-indicating tool 118 of FIG. 1, according to one or more embodiments. More particularly, FIG. 2A depicts the position-indicating tool 118 (hereafter "the tool 118") in a first or locked position, and FIG. 2B depicts the tool 118 in a second or free position. As illustrated, the tool 118 is arranged within the wellbore tubing 114 and generally positioned at one of the indicator profiles 116 generally described above.

The tool 118 may include an outer mandrel 202 and an inner mandrel 204 at least partially offset radially from the outer mandrel 202. In operation, as will be described below, the outer and inner mandrels 202, 204 may be configured to axially translate with respect to each other and thereby move the tool 118 between the first and second positions. The tool 118 may have an upper end 206*a* and a lower end 206*b*. The tool 118 may be operatively coupled to an upper tubing 208*a* at the upper end 206*a* and a lower tubing 208*b* at the lower end 206*b*. The upper and lower tubings 208*a,b* may form corresponding parts of the work string 120 (FIG. 1), such that the tool 118 interposes upper and lower portions thereof. The tool 118 may be coupled to the upper tubing 208*a* via a common pipe thread engagement (as illustrated). In some embodiments, the lower tubing 208*b* may be threaded to the lower end 206*b*. In other embodiments, however, the lower tubing 208*b* may be omitted and the tool 118 may instead be arranged at the distal end of the work string 120.

The tool 118 may further include a pressure block 210 and a sealing ring 212, each being radially arranged between the outer and inner mandrels 202, 204. The pressure block 210 generally controls a flow of hydraulic fluid between an upper hydraulic chamber 214*a* and lower hydraulic chamber 214*b*. The upper hydraulic chamber 214*a* may be defined radially between the outer and inner mandrels 202, 204 and axially between the pressure block 210 and the sealing ring 212. The lower hydraulic chamber 214*b* may also be defined radially between the outer and inner mandrels 202, 204, but axially between the pressure block 210 and a lower end wall 216 of the inner mandrel 204. Corresponding fill ports 218*a* and 218*b* may be defined in the outer mandrel 202 and configured to provide fluidic access into the upper and lower hydraulic chambers 214*a,b*, respectively, in order to be able to fill each chamber 214*a,b* with hydraulic fluid.

The pressure block 210 may be secured against axial movement with respect to the outer mandrel 202 such that movement of the outer mandrel 202 correspondingly moves the pressure block 210. This may be accomplished using a radial shoulder 220 that biases one axial end of the pressure block 210 and a snap ring 222 that biases the opposing axial end of the pressure block 210. As illustrated, the radial shoulder 220 may be defined on the outer mandrel 202 and otherwise extending radially inward therefrom. The snap ring 222 may be configured to secure the pressure block 210 against the radial shoulder 220. In at least one embodiment, the snap ring 222 may be omitted, and the pressure block 210 may instead be threaded to the outer mandrel 202 and advanced axially until engaging the radial shoulder 220.

The sealing ring 212 may be secured against axial movement with respect to the inner mandrel 204 such that movement of the inner mandrel 204 correspondingly moves the sealing ring 212. As illustrated, this may be accomplished by arranging the sealing ring 212 between an upper snap ring 224*a* and a lower snap ring 224*b*. In at least one embodiment, one of the upper or lower snap rings 224*a,b* may be replaced with a radial shoulder, similar to the radial shoulder 220, without departing from the scope of the disclosure. In operation, the sealing ring 212 may be characterized as a stationary piston, a retainer seal, or the like.

Each of the pressure block 210 and the sealing ring 212 may include one or more inner and outer sealing elements 226 configured to provide a hydraulic seal such that fluids (e.g., hydraulic fluids, gases, etc.) are unable to migrate in either axial direction past the pressure block 210 and the sealing ring 212. The inner mandrel 204 may also include one or more sealing elements 226 (one shown) configured to seal an interface between the outer and inner mandrels 202, 204 as the outer mandrel 202 axially moves with respect to the inner mandrel 204. In some embodiments, one or more of the sealing elements 226 may be O-rings. In other embodiments, one or more of the sealing elements 226 may be another type or design of elastomeric sealing element known to those skilled in the art.

The pressure block 210 may define or otherwise provide a fluid conduit 228 that extends from the upper hydraulic chamber 214*a* to the lower hydraulic chamber 214*b*. A fluid metering valve 230 may be arranged within the fluid conduit 228 and may be configured to control the flow of hydraulic fluid between the upper and lower hydraulic chambers 214*a,b* via the fluid conduit 228. In some embodiments, the fluid metering valve 230 may be a viscosity-independent, pressure-activated restrictor valve that requires a predetermined threshold pressure to be exceeded or otherwise overcome before hydraulic fluid will flow through the valve 230. Accordingly, until the threshold pressure is exceeded, no hydraulic fluid is able to transfer from the lower hydraulic chamber 214*b* to the upper hydraulic chamber 214*a*. In at least one embodiment, a suitable fluid metering valve 230 may be commercially-available from The Lee Company of Westbrook, Conn., USA. It should be noted that while only one fluid metering valve 230 is depicted, it is contemplated herein to employ more than one fluid metering valve 230, without departing from the scope of the disclosure.

Once the threshold pressure of the fluid metering valve 230 is exceeded, a steady rate of flow through the fluid conduit 228 is achieved regardless of the viscosity of the hydraulic fluid. As will be discussed in more detail below, a steady rate of flow translates into a steady and predictable rate of movement for the outer mandrel 202 with respect to the inner mandrel 204, and the predictable rate of movement for the outer mandrel 202 provides a well operator with a predictable time period required for bypassing the indicator profile 116. While virtually any incompressible fluid may be used as the hydraulic fluid in the tool 118, in accordance with the present disclosure, one suitable hydraulic fluid that may be used is high-grade automatic transmission fluid (ATF), available at any automotive parts retailer. However, other hydraulic fluids may be used, such as oils or silicon fluids and the like, which are known and used by those of ordinary skill in the art.

The tool 118 may further include two or more indicator lugs 232 (one shown) movably arranged within corresponding lug grooves 234 defined or otherwise provided in the outer mandrel 202. The indicator lugs 232 may be radially spaced around the circumference of the tool 118 and held in precise radial angles from each other by the corresponding lug grooves 234. As will be appreciated, the number of lug grooves 234 provided by the outer mandrel 202 may be equal to the number of indicator lugs 232 employed in the tool 118.

The inner mandrel 204 may define or otherwise provide a radial protrusion 236, and a release groove 238 and a support groove 240 defined on opposing axial sides of the radial protrusion 236. As illustrated, the radial protrusion 236 extends radially outward from the inner mandrel 204 and may radially support the indicator lugs 232 when the tool 118 is in the first position. More particularly, the radial protrusion 236 may be configured to force the indicator lugs 232 radially outward such that each indicator lug 232 extends past the outer diameter of the tool 118 (e.g., the outer mandrel 202). The release groove 238 may be provided downhole from the radial protrusion 236, and the support groove 240 may be provided uphole from the radial protrusion 236.

As illustrated, the axial edges or ends of each of the indicator lugs 232, the radial protrusion 236, and the indicator profile 116 may be chamfered or otherwise beveled. The beveled axial edges or ends of the indicator lugs 232, the radial protrusion 236, and the indicator profile 116 allows shear forces assumed by the indicator lugs 232, and caused by axial forces applied to the outer and inner mandrels 202, 204, to be redirected as radially inward or outward forces applied on each indicator lug 232. As will be appreciated, the beveled axial edges or ends may help the indicator lugs 232 reliably engage and disengage the indicator profile 116 and the radial protrusion 236 with little tendency of hanging up during operation.

A lug support 242 and corresponding support spring 244 may be generally arranged within the support groove 240. The lug support 242 may include one or more support shoulders 246 (one shown) that extend radially into the lug grooves 234. The support spring 244 may be a helical compression spring generally arranged between the support shoulder 246 and an upper end wall 248. In its expanded configuration, as depicted in FIGS. 2A and 2B, the support spring 244 biases the lug support 242 generally against the radial protrusion 236 such that the lug support 242 is able to axially hold or support the indicator lugs 232 on top of the radial protrusion 236 when the tool 118 is in its first position.

In the first position, as shown in FIG. 2A, the outer mandrel 202 is seated axially against an upper axial shoulder 250 defined on the inner mandrel 204. More particularly, a power spring 252 may be arranged between opposing lower axial shoulders 254*a* and 254*b* of the outer and inner mandrels 202, 204, respectively. Similar to the support spring 244, the power spring 252 may be a helical compression spring. In its expanded configuration, as depicted in FIG. 2A, the power spring 252 may serve to force the outer mandrel 202 against the upper axial shoulder 250.

With continued reference to FIGS. 2A and 2B, exemplary operation of the tool 118 will now be provided. When it is desired to precisely locate a downhole tool (not shown) within the wellbore tubing 114, the tool 118 may be moved in a first or uphole direction, as indicated by the arrow A. The tool 118 may be moved in the first direction A, for example, by being pulled uphole using the work string 120 (FIG. 1) and associated upper tubing 208*a*. When the tool 118 is in its first position, the indicator lugs 232 may be radially supported on the radial protrusion 236 and thereby extend radially past the outer diameter of the tool 118 (i.e., the outer mandrel 202). As a result, when the tool 118 is moved in the first direction A the indicator lugs 232 may be configured to eventually engage or otherwise locate the indicator profile 116.

Once the indicator lugs 232 engage the indicator profile 116, axial movement of the tool 118 in the first direction A ceases. More particularly, the indicator lugs 232 may assume the axial load applied on the tool 118 and transfer that axial load to the outer mandrel 202 that, in turn, transfers the axial load to the pressure block 210 via the radial shoulder 220. In the first position, the hydraulic fluid in the upper and lower hydraulic chambers 214*a,b* is static. Until the hydraulic fluid in the lower hydraulic chamber 214*b* is able to breach the fluid metering valve 230 and thereby migrate out of the lower hydraulic chamber 214*b* and into the upper hydraulic chamber 214*a*, the outer mandrel 202 is unable to move with respect to the inner mandrel 204.

In order to breach the fluid metering valve 230, and thereby move the outer mandrel 202 with respect to the inner mandrel 204, a prescribed or otherwise predetermined axial load may be applied on the tool 118 via the work string 120 (FIG. 1) and associated upper tubing 208*a*. The prescribed axial load may correspond to a pressure threshold required to breach the fluid metering valve 230 in the pressure block 210. Moreover, the axial load required to exceed the pressure threshold will depend on the piston area defined by the upper and lower hydraulic chambers 214*a,b* and the fluid resistance of the fluid metering valve 230. Dynamic flow from the lower hydraulic chamber 214*b* to the upper hydraulic chamber 214*a* can only occur when the pressure inside the lower hydraulic chamber 214*b* exceeds the pressure threshold of the fluid metering valve 230. As will be appreciated, the pressure threshold may be designed for any predetermined axial load, and may otherwise be optimized to fit particular applications or rig capabilities.

Once the predetermined axial load is applied via the work string 120 (FIG. 1) and the pressure threshold of the fluid metering valve 230 is thereby exceeded, the hydraulic fluid is allowed to penetrate and is otherwise forced through the fluid metering valve 230 and into the upper hydraulic chamber 214*a* via the fluid conduit 228. The path of the hydraulic fluid flow is depicted in FIG. 2A with arrows from the lower hydraulic chamber 214*b* to the upper hydraulic chamber 214*a*. The hydraulic fluid may slowly flow into the upper hydraulic chamber 214*a* at a predetermined steady flow rate, where the flow rate is determined by the parameters of the fluid metering valve 230.

Referring to FIG. 2B, the tool 118 has moved into its second position. The steady rate of the hydraulic fluid flow from the lower hydraulic chamber 214*b* to the upper hydraulic chamber 214*a* translates into a steady and predictable rate of axial movement for the outer mandrel 202 with respect to the inner mandrel 204. As a result, a well operator may be able to approximately gauge how much time may be required to move the tool 118 from the first position, as shown in FIG. 2A, to the second position, as shown in FIG. 2B. The predetermined axial load is applied for a certain period of time until enough fluid had passed from the between the lower hydraulic chamber 214*b* to the upper hydraulic chamber 214*a*, thereby allowing the inner mandrel 204, which supports the indicator lugs 232, to move far enough in the first direction A to un-support the indicator lugs 232.

In the second position, the outer mandrel 202 and the pressure block 210 have axially moved with respect to the inner mandrel 204, thereby separating the outer mandrel 202 from the upper axial shoulder 250 and simultaneously compressing the power spring 252 to a compressed configuration. Most (if not all) of the hydraulic fluid has entered the upper hydraulic chamber 214*a* as the pressure block 210 moves and comes into close contact or otherwise axially adjacent the lower end wall 216 of the inner mandrel 204. Moreover, as the tool 118 moves into the second position, the indicator lugs 232 may be forced by the indicator profile 116 to slide off of engagement with the outer surface of the radial protrusion 236 and radially contract upon being able to enter the release groove 238. Again, the beveled axial edges or ends of the indicator lugs 232, the radial protrusion 236, and the indicator profile 116 may help ease the transition of the indicator lugs 232 from atop the radial protrusion 236 to the release groove 238. Once in the release groove 238, the indicator lugs 232 no longer extend past the outer diameter of the tool 118, thereby allowing the tool 118 to axially traverse the indicator profile 116 in the first direction A.

In some embodiments, one or both of the fill ports 218*a,b* may also serve as a pressure relief device, such as a burst disc or the like, and may be configured to depressurize the upper and/or lower hydraulic chambers 214*a,b* in the event that the fluid metering valve 230 malfunctions or otherwise ceases to work. In such a scenario, the well operator may be able to apply an axial load (either tension or compression) on the tool 118 from the surface and thereby pressurize the upper and/or lower hydraulic chambers 214*a,b* to a failure pressure threshold corresponding to the pressure relief device 218*a,b*. Once the failure pressure threshold is attained, the pressure relief device 218*a,b* may be configured to fail and thereby remove the hydraulic resistance within the tool 118. As a result, the tool 118 may be able to bypass any indicator profiles 116 and pulled back to the surface.

Figure 3:
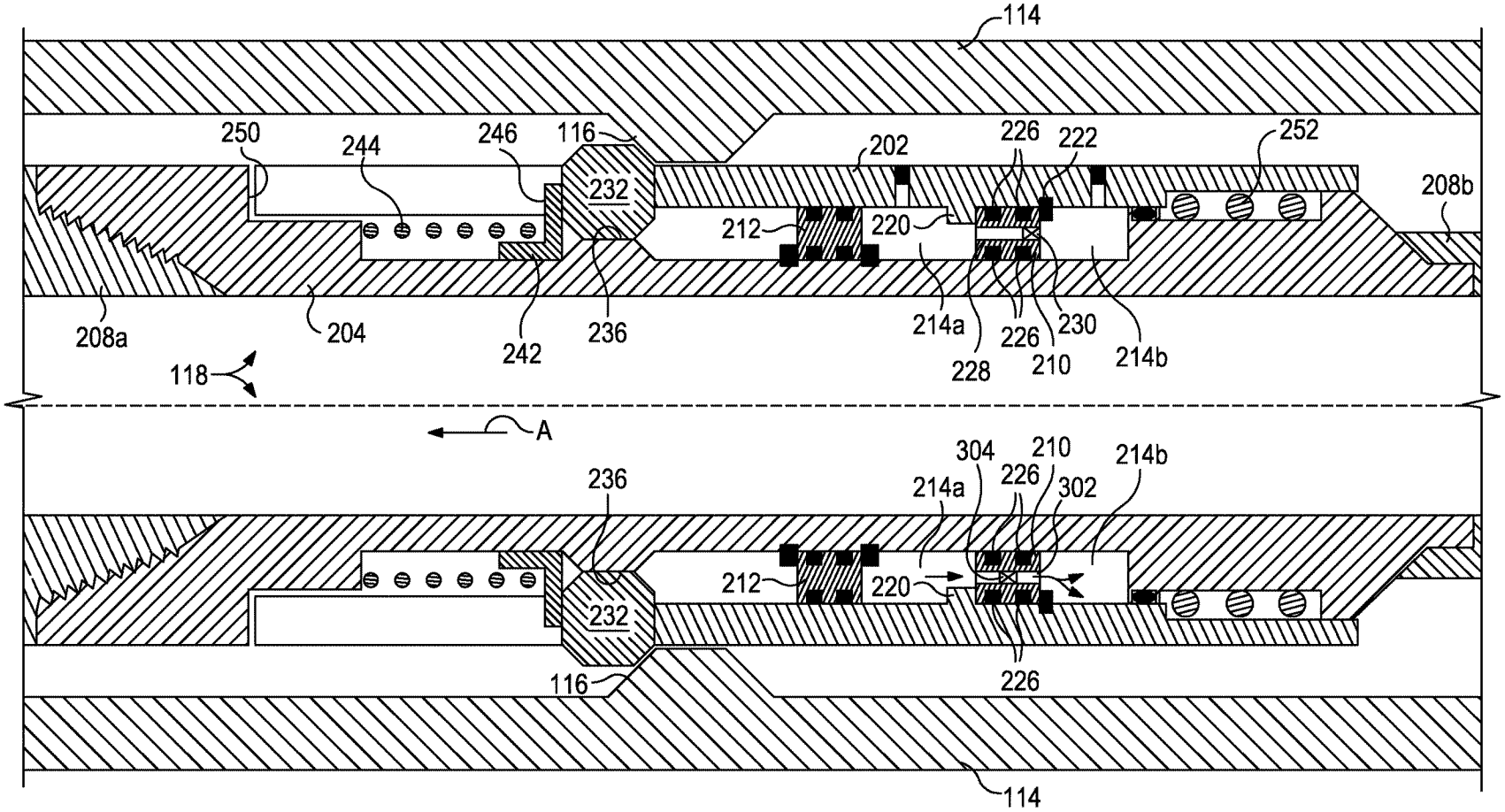
FIG. 3 illustrates another cross-sectional side view of the exemplary position-indicating tool of FIG. 1, according to one or more embodiments.

Referring now to FIG. 3, with continued reference to FIGS. 2A and 2B, illustrated is another cross-sectional side view of the exemplary position-indicating tool 118 of FIG. 1, according to one or more embodiments. More particularly, FIG. 3 depicts the tool 118 as it returns to the first configuration. Continued movement of the inner mandrel 204 in the first direction A will result in the tool 118 axially bypassing the indicator profile 116. Once the indicator lugs 232 are out of radial engagement with the indicator profile 116, and therefore able to radially expand once again, the spring force built up in the power spring 252 may be released, and thereby forcing the lower mandrel 202 back over the inner mandrel 204 until the outer mandrel 202 engages the upper axial shoulder 250 once again.

Moving the outer mandrel 202 back over the inner mandrel 204 forces the indicator lugs 232 (which are still arranged within the corresponding lug grooves 234) against the radial protrusion 236. The beveled axial edges or ends of the indicator lugs 232 and the radial protrusion 236 may help the indicator lugs 232 exit the release groove 238 and otherwise radially expand until the outer mandrel 202 places the indicator lugs 232 back on top of the radial protrusion 236, thereby radially supporting the indicator lugs 232 once again.

In order for the outer mandrel 202 to move back over the inner mandrel 204, and the pressure block 210 to axially separate from the lower end wall 216 of the inner mandrel 204, the hydraulic fluid from the upper hydraulic chamber 214*a* must return somehow to the lower hydraulic chamber 214*b*. To accomplish this, the pressure block 210 may further define or otherwise provide a return fluid conduit 302 that extends from the upper hydraulic chamber 214*a* to the lower hydraulic chamber 214*b*. A check valve 304 may be arranged within the return fluid conduit 302 and may be configured to control the flow of hydraulic fluid from the upper hydraulic chamber 214*a* to the lower hydraulic chamber 214*b*. In some embodiments, the return fluid conduit 302 and associated check valve 304 may be arranged radially opposite the fluid conduit 228 and associated fluid metering valve 230, as illustrated. In other embodiments, the return fluid conduit 302 and associated check valve 304 may be arranged at any angular offset from the fluid conduit 228 and associated fluid metering valve 230, without departing from the scope of the disclosure.

The check valve 304 may be a low-pressure or low-force check valve that offers very low resistance for fluids flowing from the upper hydraulic chamber 214*a* into the lower hydraulic chamber 214*b*. As a result, the spring force of the power spring 252 may exhibit sufficient force required to flow the hydraulic fluid from the upper hydraulic chamber 214*a* into the lower hydraulic chamber 214*b*, as indicated by the arrows. It should be noted that while only one check valve 304 is depicted, it is contemplated herein to employ more than one fluid check valve 304, without departing from the scope of the disclosure.

Figure 4A:
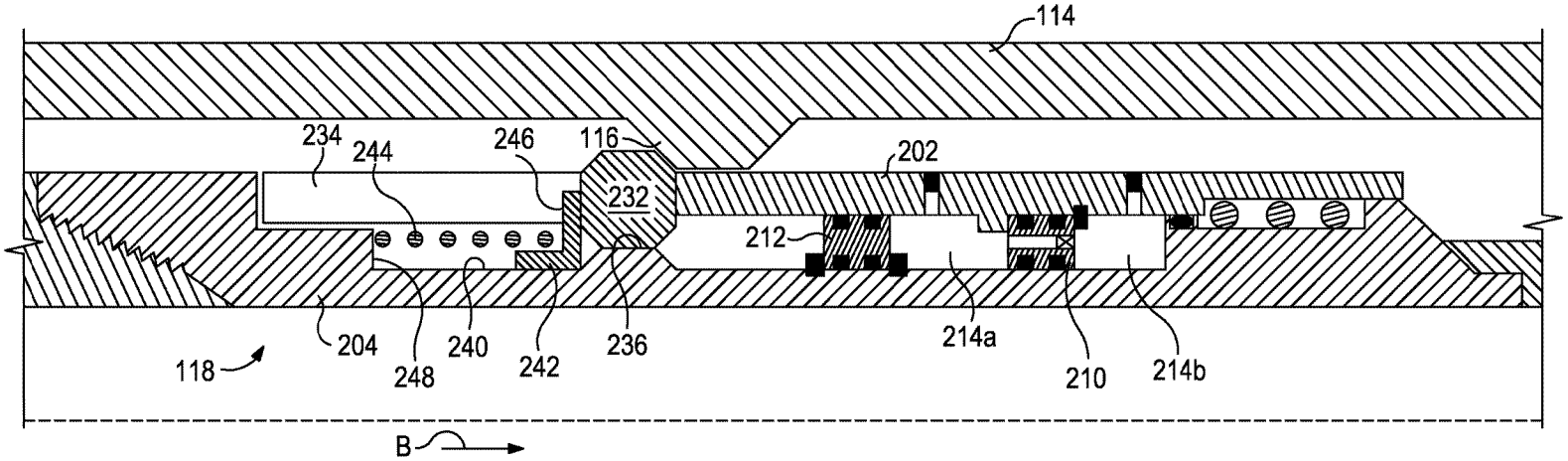
FIGS. 4A and 4B illustrate are cross-sectional side views of the exemplary position-indicating tool of FIG. 1, according to one or more additional embodiments.
Figure 4B:
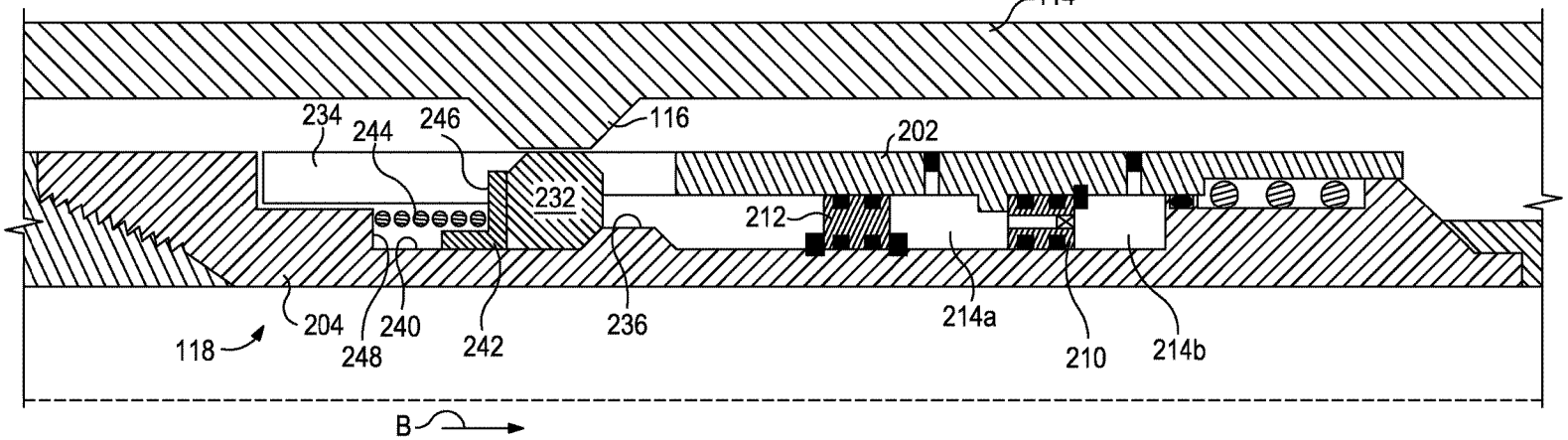

Referring now to FIGS. 4A and 4B, with continued reference to the prior figures, illustrated are cross-sectional side views of the exemplary position-indicating tool 118 of FIG. 1, according to one or more additional embodiments. More particularly, FIGS. 4A and 4B depict exemplary operation of the tool 118 during run-in into the wellbore 106 (FIG. 1) in a second direction, indicated by the arrow B. FIG. 4A depicts the tool 118 in the first position during run-in, and FIG. 4B depicts the tool 118 in a third position during run-in. As with prior figures, the tool 118 is again arranged within the wellbore tubing 114 and generally positioned at one of the indicator profiles 116 generally described above.

In FIG. 4A, the tool 118 is moving in the second direction B and approaching the indictor profile 116. Again, when the tool 118 is in the first position, the indicator lugs 232 are radially supported by the radial protrusion 236, which places the indicator lugs 232 radially past the outer diameter of the tool 118 (i.e., the outer mandrel 202). As a result, when the tool 118 is moved in the second direction B, the indicator lugs 232 may engage or otherwise come into contact with the indicator profile 116. Once the indicator lugs 232 engage the indicator profile 116, the indicator lugs 232 assume the axial load applied on the tool 118 in the direction B and transfer that axial load to the lug support 242 at the support shoulders 246 that extend into the lug grooves 234. As a result, the lug support 242 acts on and compresses the support spring 244 arranged between the support shoulder 246 and the upper end wall 248 of the inner mandrel 204.

In FIG. 4B, the tool 118 has moved into the third position. As the tool 118 moves into the third position, the indicator lugs 232 may be forced by the indicator profile 116 to slide off engagement with the outer surface of the radial protrusion 236 and radially contract upon being able to enter the support groove 240. Again, the beveled axial edges or ends of the indicator lugs 232, the radial protrusion 236, and the indicator profile 116 may help ease the transition of the indicator lugs 232 from atop the radial protrusion 236 to the support groove 240. Once in the support groove 240, the indicator lugs 232 no longer extend past the outer diameter of the tool 118, thereby allowing the tool 118 to axially traverse the indicator profile 116 in the second direction B.

Continued movement of the tool 118 in the second direction B will result in the tool 118 axially bypassing the indicator profile 116. Once the indicator lugs 232 are out of radial engagement with the indicator profile 116, and therefore able to radially expand once again, the spring force built up in the support spring 244 may be released, thereby forcing the indicator lugs 232 against the radial protrusion 236. The beveled axial edges or ends of the indicator lugs 232 and the radial protrusion 236 may help the indicator lugs 232 exit the support groove 240 and otherwise radially expand until the indicator lugs 232 are once again radially supported atop the radial protrusion 236 and thereby assuming the first position once again.

Embodiments Disclosed Herein Include:

A. A position-indicating tool that may include an outer mandrel defining two or more lug grooves that accommodate a corresponding two or more indicator lugs movable between a first position, where the two or more indicator lugs extend past an outer diameter of the outer mandrel, and a second position, where the two or more indicator lugs are radially contracted within the outer diameter, an inner mandrel arranged at least partially within the outer mandrel and providing a radial protrusion that radially supports the two or more indicator lugs in the first position, and a pressure block arranged between the outer and inner mandrels and configured to control a flow of hydraulic fluid between an upper hydraulic chamber and a lower hydraulic chamber, wherein, when a pressure threshold is exceeded in the lower hydraulic chamber, the hydraulic fluid is able to flow into the upper hydraulic chamber and thereby allow the outer mandrel to axially translate with respect to the inner mandrel and move the two or more indicator lugs to the second position.

B. A well system that may include a wellbore tubing having at least one indicator profile defined on an inner radial surface thereof, a position-indicating tool extendable within the wellbore tubing and movable between a first position, where two or more indicator lugs extend past an outer diameter of the position-indicating tool and are therefore axially engageable with the at least one indicator profile, and a second position, where the two or more indicator lugs are radially contracted and thereby allow the position-indicating tool to bypass the at least one indicator profile, a pressure block arranged between outer and inner mandrels of the position-indicating tool and configured to control a flow of hydraulic fluid between an upper hydraulic chamber and a lower hydraulic chamber, wherein, when a pressure threshold is exceeded in the lower hydraulic chamber, the hydraulic fluid is able to flow into the upper hydraulic chamber and thereby allow the position-indicating tool to move to the second position.

C. A method that may include introducing a position-indicating tool into a wellbore tubing having at least one indicator profile defined on an inner radial surface thereof, the position-indicating tool having a pressure block arranged between outer and inner mandrels and configured to control a flow of hydraulic fluid between an upper hydraulic chamber and a lower hydraulic chamber, advancing the position-indicating tool in a first axial direction within the wellbore tubing while the position-indicating tool is in a first position where two or more indicator lugs extend past an outer diameter of the position-indicating tool, axially engaging the at least one indicator profile with the two or more indicator lugs in the first axial direction, applying a predetermined axial force on the position-indicating tool against the at least one indicator profile in the first axial direction and thereby exceeding a pressure threshold within the lower hydraulic chamber, and moving the position-indicating tool into a second position as the hydraulic fluid flows into the upper hydraulic chamber through the pressure block wherein, when in the second position, the two or more indicator lugs are radially contracted and thereby enable the position-indicating tool to axially bypass the at least one indicator profile in the first axial direction.

Each of embodiments A, B, and C may have one or more of the following additional elements in any combination: Element 1: wherein the pressure block is secured against axial movement with respect to the outer mandrel such that movement of the outer mandrel correspondingly moves the pressure block. Element 2: further comprising a fluid conduit defined in the pressure block to fluidly communicate the upper and lower hydraulic chambers, and a fluid metering valve arranged within the fluid conduit and configured to control the flow of hydraulic fluid from the lower hydraulic chamber to the upper hydraulic chamber when the pressure threshold is exceeded. Element 3: further comprising a sealing ring arranged between the outer and inner mandrels and axially offset from the pressure block, the upper hydraulic chamber being defined axially between the sealing ring and the pressure block, and one or more inner and outer sealing elements arranged about the pressure block and the sealing ring and configured to generate a hydraulic seal that prevents fluids from migrating in either axial direction past the pressure block and the sealing ring. Element 4: further comprising a release groove defined on a first axial side of the radial protrusion, the release groove being configured to receive the two or more indicator lugs in the second position, a support groove defined on a second axial side of the radial protrusion, the second axial side being opposite the first axial side, and a lug support arranged within the support groove, the lug support having one or more support shoulders that extend radially into the lug grooves and axially support the two or more indicator lugs on the radial protrusion in the first position. Element 5: wherein the two or more indicator lugs are movable to a third position where the two or more indicator lugs are received into the support groove and radially contracted within the outer diameter of the outer mandrel, and wherein, when in the third position, the two or more indicator lugs axially engage the lug support and compress a support spring. Element 6: further comprising a power spring arranged axially between the outer and inner mandrels, the power spring being movable between an expanded configuration, when the two or more lugs are in the first position, and a contracted configuration, when the two or more indicator lugs are in the second position, and wherein the power spring is configured to move the two or more indicator lugs back to the first position. Element 7: further comprising one or more pressure relief devices in fluid communication with one or both of the upper and lower hydraulic chambers, the one or more pressure relief devices being configured to fail upon assuming a failure pressure threshold within one or both of the upper and lower hydraulic chambers.

Element 8: further comprising a conveyance operatively coupled to the position-indicating tool and configured to convey the position-indicating tool into the wellbore tubing, wherein, when the two or more indicator lugs are axially engaged against the at least one indicator profile in a first axial direction, a predetermined axial load is applied on the position-indicating tool via the conveyance in order to move the position-indicating tool from the first position to the second position. Element 9: further comprising a fluid conduit defined in the pressure block to place the upper and lower hydraulic chambers in fluid communication, and a fluid metering valve arranged within the fluid conduit and configured to control the flow of hydraulic fluid from the lower hydraulic chamber to the upper hydraulic chamber when the pressure threshold is exceeded in the lower hydraulic chamber, wherein, the predetermined axial load acts on the pressure block and thereby increases pressure within the lower hydraulic chamber to exceed the pressure threshold. Element 10: wherein the pressure block is secured against axial movement with respect to the outer mandrel such that movement of the outer mandrel correspondingly moves the pressure block. Element 11: further comprising a power spring arranged axially between the outer and inner mandrels, the power spring being movable between an expanded configuration, where the position-indicating tool is in the first position, and a contracted configuration, where position-indicating tool is in the second position, and wherein the power spring is configured to move the position-indicating tool back to the first position. Element 12: further comprising a radial protrusion defined on the inner mandrel, the radial protrusion being configured to radially support the two or more indicator lugs when the position-indicating tool is in the first position, a release groove defined on a first axial side of the radial protrusion, the release groove being configured to receive the two or more indicator lugs in the second position, a support groove defined on a second axial side of the radial protrusion, and a lug support arranged within the support groove, the lug support being configured to axially support the two or more indicator lugs on the radial protrusion in the first position. Element 13: wherein the position-indicating tool is movable to a third position where the two or more indicator lugs are received into the support groove and axially engage the lug support and thereby compress a support spring.

Element 14: wherein a conveyance is operatively coupled to the position-indicating tool to convey the position-indicating tool into the wellbore tubing, and wherein applying the predetermined axial force on the position-indicating tool comprises applying the predetermined axial force on the position-indicating tool in the first axial direction via the conveyance. Element 15: wherein the pressure block defines a fluid conduit that fluidly communicates the upper and lower hydraulic chambers and a fluid metering valve is arranged within the fluid conduit, the method further comprising flowing the hydraulic fluid through the fluid metering valve from the lower hydraulic chamber to the upper hydraulic chamber at a predictable rate and moving the position-indicating tool from the first position to the second position at the predictable rate. Element 16: wherein moving the position-indicating tool into the second position further comprises moving the two or more indicator lugs from being radially supported by a radial protrusion defined on the inner mandrel to being received by a release groove defined on an axial side of the radial protrusion, and compressing a power spring from an expanded configuration to a compressed configuration, the power spring being axially arranged between the outer and inner mandrels. Element 17: further comprising advancing the position-indicating tool past the at least one indicator profile in the first axial direction, moving the position-indicating tool back to the first position as the power spring expands from the compressed configuration back to the expanded configuration, and lowing the hydraulic fluid from the upper hydraulic chamber to the lower hydraulic chamber via a return fluid conduit defined in the pressure block, the return fluid conduit having a check valve arranged therein. Element 18: wherein the at least one indicator profile is a first indicator profile, the method further comprising advancing the position-indicating tool within the wellbore tubing in a second axial direction opposite the first axial direction while the position-indicating tool is in the first position, axially engaging the a second indicator profile with the two or more indicator lugs in the second axial direction, moving the position-indicating tool into a third position where the two or more indicator lugs are received into a support groove defined on an axial side of the radial protrusion and are radially contracted such that the position-indicating tool is able to axially bypass the second indicator profile in the second axial direction, axially engaging a lug support arranged within the support groove with the two or more indicator lugs, and compressing a support spring arranged within the support groove from an expanded configuration to a compressed configuration as the two or more indicator lugs axially engage the lug support. Element 19: further comprising advancing the position-indicating tool past the at least one indicator profile in the second axial direction, and moving the position-indicating tool back to the first position as the support spring expands from the compressed configuration back to the expanded configuration.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

What is claimed is:

1. A position-indicating tool, comprising:

an outer mandrel defining two or more lug grooves that accommodate a corresponding two or more indicator lugs movable between a first position, where the two or more indicator lugs extend past an outer diameter of the outer mandrel, and a second position, where the two or more indicator lugs are radially contracted within the outer diameter;

an inner mandrel arranged at least partially within the outer mandrel and providing a radial protrusion that radially supports the two or more indicator lugs in the first position; and a pressure block arranged between the outer and inner mandrels and comprising a fluid metering valve configured to control a flow of hydraulic fluid between an upper hydraulic chamber and a lower hydraulic chamber, wherein, when a pressure threshold of the fluid metering valve is exceeded, the hydraulic fluid flows at a steady rate from the lower hydraulic chamber to the upper hydraulic chamber thereby allowing the outer mandrel to axially translate at a steady rate with respect to the inner mandrel and move the two or more indicator lugs to the second position.

2. The position-indicating tool of claim 1, wherein the pressure block is secured against axial movement with respect to the outer mandrel such that movement of the outer mandrel correspondingly moves the pressure block.

3. The position-indicating tool of claim 1, further comprising:

a fluid conduit defined in the pressure block to fluidly communicate the upper and lower hydraulic chambers, wherein the fluid metering valve is arranged within the fluid conduit.

4. The position-indicating tool of claim 1, further comprising:

a sealing ring arranged between the outer and inner mandrels and axially offset from the pressure block, the upper hydraulic chamber being defined axially between the sealing ring and the pressure block; and one or more inner and outer sealing elements arranged about the pressure block and the sealing ring and configured to generate a hydraulic seal that prevents fluids from migrating in either axial direction past the pressure block and the sealing ring.

5. The position-indicating tool of claim 1, further comprising:

a release groove defined on a first axial side of the radial protrusion, the release groove being configured to receive the two or more indicator lugs in the second position;

a support groove defined on a second axial side of the radial protrusion, the second axial side being opposite the first axial side; and a lug support arranged within the support groove, the lug support having one or more support shoulders that extend radially into the lug grooves and axially support the two or more indicator lugs on the radial protrusion in the first position.

6. The position-indicating tool of claim 5, wherein the two or more indicator lugs are movable to a third position where the two or more indicator lugs are received into the support groove and radially contracted within the outer diameter of the outer mandrel, and wherein, when in the third position, the two or more indicator lugs axially engage the lug support and compress a support spring.

7. The position-indicating tool of claim 1, further comprising a power spring arranged axially between the outer and inner mandrels, the power spring being movable between an expanded configuration, when the two or more indicator lugs are in the first position, and a contracted configuration, when the two or more indicator lugs are in the second position, and wherein the power spring is configured to move the two or more indicator lugs back to the first position.

8. The position-indicating tool of claim 1, further comprising one or more pressure relief devices in fluid communication with one or both of the upper and lower hydraulic chambers, the one or more pressure relief devices being configured to fail upon assuming a failure pressure threshold within one or both of the upper and lower hydraulic chambers.

9. A well system, comprising:

a wellbore tubing having at least one indicator profile defined on an inner radial surface thereof;

a position-indicating tool extendable within the wellbore tubing and movable between a first position, where two or more indicator lugs extend past an outer diameter of the position-indicating tool and are therefore axially engageable with the at least one indicator profile, and a second position, where the two or more indicator lugs are radially contracted and thereby allow the position-indicating tool to bypass the at least one indicator profile; and a pressure block arranged between outer and inner mandrels of the position-indicating tool and comprising a fluid metering valve configured to control a flow of hydraulic fluid between an upper hydraulic chamber and a lower hydraulic chamber, wherein, when a pressure threshold of the fluid metering valve is exceeded, the hydraulic fluid flows at a steady rate from the lower hydraulic chamber to the upper hydraulic chamber thereby allowing the outer mandrel to axially translate at a steady rate with respect to the inner mandrel and move the two or more indicator lugs to the second position.

10. The well system of claim 9, further comprising a conveyance operatively coupled to the position-indicating tool and configured to convey the position-indicating tool into the wellbore tubing, wherein, when the two or more indicator lugs are axially engaged against the at least one indicator profile in a first axial direction, a predetermined axial load is applied on the position-indicating tool via the conveyance in order to move the position-indicating tool from the first position to the second position.

11. The well system of claim 10, further comprising:

a fluid conduit defined in the pressure block to place the upper and lower hydraulic chambers in fluid communication; and a fluid metering valve arranged within the fluid conduit and configured to control the flow of hydraulic fluid from the lower hydraulic chamber to the upper hydraulic chamber when the pressure threshold is exceeded in the lower hydraulic chamber, wherein, the predetermined axial load acts on the pressure block and thereby increases pressure within the lower hydraulic chamber to exceed the pressure threshold.

12. The well system of claim 9, wherein the pressure block is secured against axial movement with respect to the outer mandrel such that movement of the outer mandrel correspondingly moves the pressure block.

13. The well system of claim 9, further comprising a power spring arranged axially between the outer and inner mandrels, the power spring being movable between an expanded configuration, where the position-indicating tool is in the first position, and a contracted configuration, where position-indicating tool is in the second position, and wherein the power spring is configured to move the position-indicating tool back to the first position.

14. The well system of claim 9, further comprising:

a radial protrusion defined on the inner mandrel, the radial protrusion being configured to radially support the two or more indicator lugs when the position-indicating tool is in the first position;

a release groove defined on a first axial side of the radial protrusion, the release groove being configured to receive the two or more indicator lugs in the second position;

a support groove defined on a second axial side of the radial protrusion; and a lug support arranged within the support groove, the lug support being configured to axially support the two or more indicator lugs on the radial protrusion in the first position.

15. The well system of claim 14, wherein the position-indicating tool is movable to a third position where the two or more indicator lugs are received into the support groove and axially engage the lug support and thereby compress a support spring.

16. A method, comprising:

introducing a position-indicating tool into a wellbore tubing having at least one indicator profile defined on an inner radial surface thereof, the position-indicating tool having a pressure block arranged between outer and inner mandrels and comprising a fluid metering valve configured to control a flow of hydraulic fluid between an upper hydraulic chamber and a lower hydraulic chamber;

advancing the position-indicating tool in a first axial direction within the wellbore tubing while the position-indicating tool is in a first position where two or more indicator lugs extend past an outer diameter of the position-indicating tool;

axially engaging the at least one indicator profile with the two or more indicator lugs in the first axial direction;

applying a predetermined axial force on the position-indicating tool against the at least one indicator profile in the first axial direction and thereby exceeding a pressure threshold of the fluid metering valve; and moving the position-indicating tool into a second position by flowing the hydraulic fluid through the fluid metering valve at a steady rate from the lower hydraulic chamber into the upper hydraulic chamber to allow the outer mandrel to axially translate at a steady rate with respect to the inner mandrel wherein, when in the second position, the two or more indicator lugs are radially contracted and thereby enable the position-indicating tool to axially bypass the at least one indicator profile in the first axial direction.

17. The method of claim 16, wherein a conveyance is operatively coupled to the position-indicating tool to convey the position-indicating tool into the wellbore tubing, and wherein applying the predetermined axial force on the position-indicating tool comprises applying the predetermined axial force on the position-indicating tool in the first axial direction via the conveyance.

18. The method of claim 16, wherein the pressure block defines a fluid conduit that fluidly communicates the upper and lower hydraulic chambers and the fluid metering valve is arranged within the fluid conduit, the method further comprising:

flowing the hydraulic fluid through the fluid metering valve from the lower hydraulic chamber to the upper hydraulic chamber at a predictable rate; and moving the position-indicating tool from the first position to the second position at the predictable rate.

19. The method of claim 16, wherein moving the position-indicating tool into the second position further comprises:

moving the two or more indicator lugs from being radially supported by a radial protrusion defined on the inner mandrel to being received by a release groove defined on an axial side of the radial protrusion; and compressing a power spring from an expanded configuration to a compressed configuration, the power spring being axially arranged between the outer and inner mandrels.

20. The method of claim 19, further comprising:

advancing the position-indicating tool past the at least one indicator profile in the first axial direction;

moving the position-indicating tool back to the first position as the power spring expands from the compressed configuration back to the expanded configuration; and flowing the hydraulic fluid from the upper hydraulic chamber to the lower hydraulic chamber via a return fluid conduit defined in the pressure block, the return fluid conduit having the fluid metering valve arranged therein.

21. The method of claim 16, wherein the at least one indicator profile is a first indicator profile, the method further comprising:

advancing the position-indicating tool within the wellbore tubing in a second axial direction opposite the first axial direction while the position-indicating tool is in the first position;

axially engaging a second indicator profile with the two or more indicator lugs in the second axial direction;

moving the position-indicating tool into a third position where the two or more indicator lugs are received into a support groove defined on an axial side of a radial protrusion and are radially contracted such that the position-indicating tool is able to axially bypass the second indicator profile in the second axial direction;

axially engaging a lug support arranged within the support groove with the two or more indicator lugs; and compressing a support spring arranged within the support groove from an expanded configuration to a compressed configuration as the two or more indicator lugs axially engage the lug support.

22. The method of claim 21, further comprising:

advancing the position-indicating tool past the at least one indicator profile in the second axial direction; and moving the position-indicating tool back to the first position as the support spring expands from the compressed configuration back to the expanded configuration.

* * * * *